United States Patent [19]

Serracant-Clermont et al.

[11] Patent Number: 4,888,848

[45] Date of Patent: Dec. 26, 1989

[54] SYSTEM FOR TREATING FABRICS IN CORD IN CLOSED RING

[76] Inventors: Jose M. Serracant-Clermont, V.Gracia, 52; Juan Serracant-Clermont, A.Concordia, 25, both of Sabadell, Spain

[21] Appl. No.: 260,564

[22] Filed: Oct. 20, 1988

[30] Foreign Application Priority Data

Oct. 22, 1987 [ES] Spain ..... 8703023

[51] Int. Cl.[4] ..... D06B 15/04

[52] U.S. Cl. ..... 15/306 A; 26/80; 68/177; 226/95

[58] Field of Search ..... 68/20, 177, 178, DIG. 5; 15/306 R, 306 A; 34/115, 122, 156; 26/80, 81, 85; 226/95, 97; 162/368, 369

[56] References Cited

U.S. PATENT DOCUMENTS

| | | | |
|---|---|---|---|
| 3,061,159 | 10/1962 | Jacobsen | 226/97 X |
| 3,959,843 | 6/1976 | Yokota et al. | 15/306 A |
| 4,266,983 | 5/1981 | Laszlo et al. | 26/85 X |

FOREIGN PATENT DOCUMENTS

| | | | |
|---|---|---|---|
| 1382322 | 11/1964 | France | 162/368 |
| 565575 | 11/1944 | United Kingdom | 162/368 |
| 843806 | 8/1960 | United Kingdom | 15/306 A |

*Primary Examiner*—Philip R. Coe

*Attorney, Agent, or Firm*—Fleit, Jacobson, Cohn, Price, Holman & Stern

[57] ABSTRACT

System for treating fabrics in rope form in a closed ring, wet or dry, includes the arrangement of at least a main device in the form of a sucking conveying element with a perforated surface through which sucking action is applied to suck the fabrics onto a part of the perforated surface, and at least one secondary device to draw the fabrics in rope form near to the main device, the arrangement simultaneously providing positive carriage of the fabrics, and any of the operations of opening the fabrics in rope form, unfolding them transversely to their advancement direction, interchanging the fluids of the process with the fabrics and extracting such fluids in a controllable degree from the fabrics.

15 Claims, 3 Drawing Sheets

SYSTEM FOR TREATING FABRICS IN CORD IN CLOSED RING

BACKGROUND OF THE INVENTION

The present invention relates to a system for treating fabrics in rope form in a closed ring, either wet or dry.

In fabrics in rope form submitted to wet or dry processes it often happens that the fabric, more in some processes than in others, presents some lengthwise folds due to the advancement of the fabrics that during the successive stages of the process while passing through the active and advancement devices increase or remain, the folds being unwanted for the fabric after the process is finished.

The main cause of the forming and remaining of unwanted lengthwise folds is due to the repetitive passing of the fabric in rope form through the active devices or elements of the machine that operates the process without altering the position of such folds. Thus, for example, in the process of the fulling-washing machines, after passing through the actuator advancing cylinders, the rope form fabric passes through the retaining box, after which, directly or indirectly, it passes to the process bath located below, to rise again at the opposite side to the actuator cylinders, which can represent any appropriate construction and arrangement. In this case, the rope fabric, after it has been submitted to the compressing action of the cylinders, is retained in crankle folds in the retaining box, after which it passes through the lower bath and rises again to the actuator cylinders, in such a way that lengthwise folds formed on the fabric as it is passing through the actuator cylinders are kept in the same position when passing through the retaining box and the lower bath, and even though in this latter stage the fabric in rope form is opened in a certain ratio, lengthwise folds generally remain.

BRIEF SUMMARY OF THE INVENTION

It is an object of this invention to overcome the above problems and to provide a system for treatment of fabrics in rope form either wet or dry which essentially is characterized by the arrangement including at least one main device consisting in a suction carrying element having a perforated surface to suck the fabrics onto the carrying element, and at least a secondary device to draw the fabrics near to the main device. This arrangement simultaneously provides positive carriage of the fabrics in the process, and any of the following operations: open the fabrics in rope form by unfolding them transversally to their direction of advancement; interchanging the fluids of the process with the fabrics; and extracting such fluids in a controllable degree from the fabrics.

Preferably, the sucking carrying element of the main device consists in a rotary sucking cylinder which is provided with means to regulate its sucking action and its acting sucking surface on the fabrics, as well as its relative position with regard to the secondary device.

Preferably, the secondary device is a driving element constituted by an adjustable speed rotary cylinder. Such cylinder of the secondary device can be a sucking cylinder provided with means to set its sucking action and its active sucking surface on the fabrics, as well as its relative position with regard to the main device.

Also, the secondary device can consist in a conveying apron of adjustable linear speed, or an inclined plane of adjustable slope on which the fabrics slide.

BRIEF DESCRIPTION OF THE DRAWINGS

The invention of the system for treating fabrics in rope form in a closed ring or path, wet as well as dry, will now be described in detail with reference to the accompanying drawings wherein.

DETAILED DESCRIPTION

Figure 1:
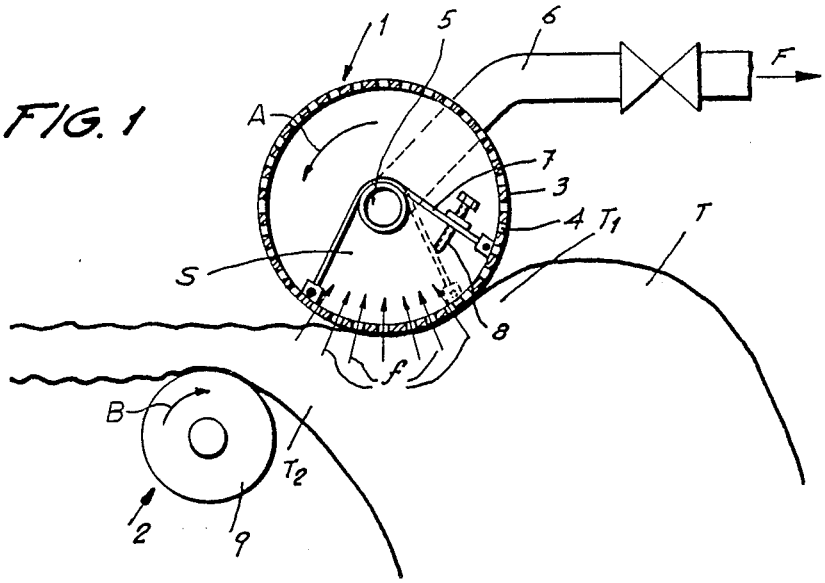
FIG. 1 is a schematic side elevational view showing the cooperating devices of the invention between which the fabric in rope form being treated passes, the fibers being opened by the action of the devices transversely to the direction of movement of the fabric.

As shown in the drawings, the system for treatment of fabric in rope form in a closed ring, wet or dry, in accordance with this invention, is applicable to any type of machine to process fabrics in rope form and includes a main device 1 and a secondary device 2. The main device 1 is constituted by a rotary cylinder 3, rotated in the direction of arrow A, having a perforated surface 4 through which sucking is effected through a central duct 5 and a duct 6 connected to duct 5, by means not illustrated, to apply a sucking F which produces a sucking f on the fabric in closed ring T onto the periphery of cylinder 3. Such rotary cylinder 3 has surface 4 perforated at least in part, for example lengthwise, and is provided with adjustable means 7 to control the sucking in sector S, which means can comprise, for example, a screw 8 or an equivalent device that varies the position of one side of the sector to vary the size thereof.

The secondary device 2 carries out the function of drawing the fabric in closed ring T, during its run, near to the main device 1, as it is shown in FIG. 1; such device consists in a driving rotary cylinder 9 of adjustable speed rotated in the direction of arrow B.

Figure 2:
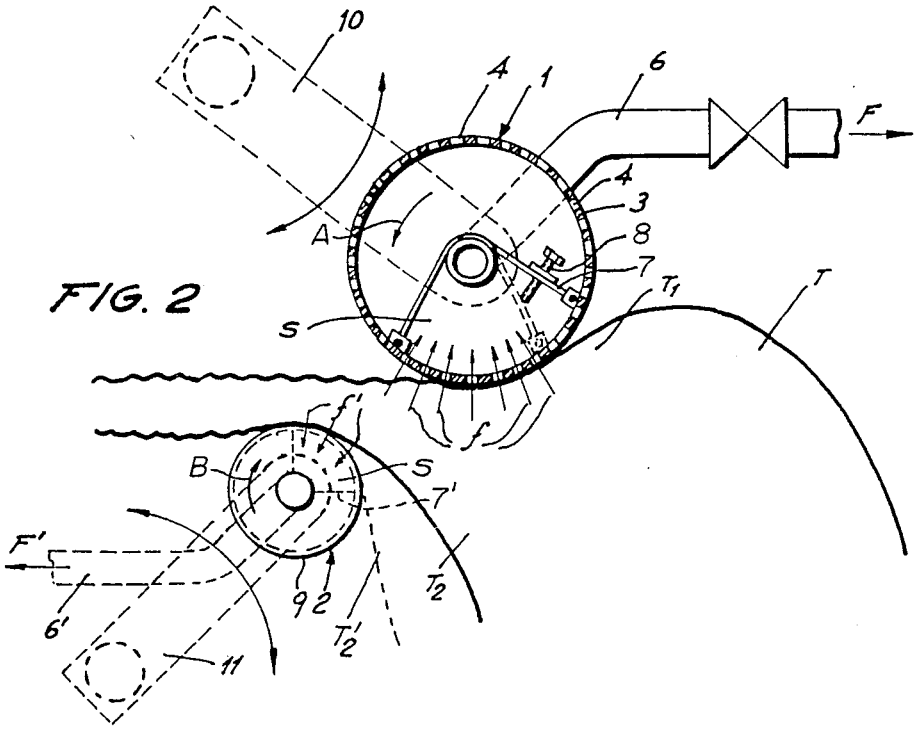
FIG. 2 is a view similar to FIG. 1 showing a different embodiment of the invention.

In FIG. 1 the main 1 and secondary 2 devices, are shown in a fixed position while in FIG. 2 is shown on embodiment for setting the relative position between both, by the arrangement of respective rotary arms 10 and 11 which support devices 1 and 2 to set such position. FIG. 2 shows schematically cylinder 9 of the secondary device 2 also perforated and means to control the sucking in the same manner as cylinder 3 of the main device 1. The arrangement of previously mentioned arms 10 and 11 associated with main 1 and secondary 2 device, respectively, allows a best fit positioning of both devices.

The arrangement of main and secondary devices 1 and 2 provides simultaneous positive movement of the fabrics in the closed ring or path T, and any of the following operations of opening the fabrics in rope form by unfolding them transversally to the direction of advancement, interchanging the fluids in the process with the fabrics in rope form, and extracting such fluids in a controllable degree from the fabrics in rope form. The "opening" of the fabrics in rope form in closed ring T by unfolding them transversally to their advancement direction is due to the fact that only one part of the fabric T1 is sucked and carried by main device 1, while the rest not sucked T2 is separated by its own weight. Such arrangement of main and secondary devices provides for the positive carriage and other operations of opening the fabric, interchanging the fluids of the process and extracting such fluids simultaneously or independently.

In main device 1 the arrangement of adjusting screw 8, or equivalent adjuster, allows setting the active sucking surface of cylinder 3 on the rope fabrics to improve the opening of the fabric matching with the setting of the relative position of both devices.

The secondary device which draws the fabric in rope form in closed ring T near to the main device can be simply a rotary driving cylinder 9, as illustrated in FIGS. 1 and 2, of adjustable speed, and can be a sucking cylinder as shown schematically in dotted line in FIG. 2, being provided with means to adjust the sucking sector and its active sucking surface on the fabrics, as well as its relative position with regard to the main device 1.

Figure 3:
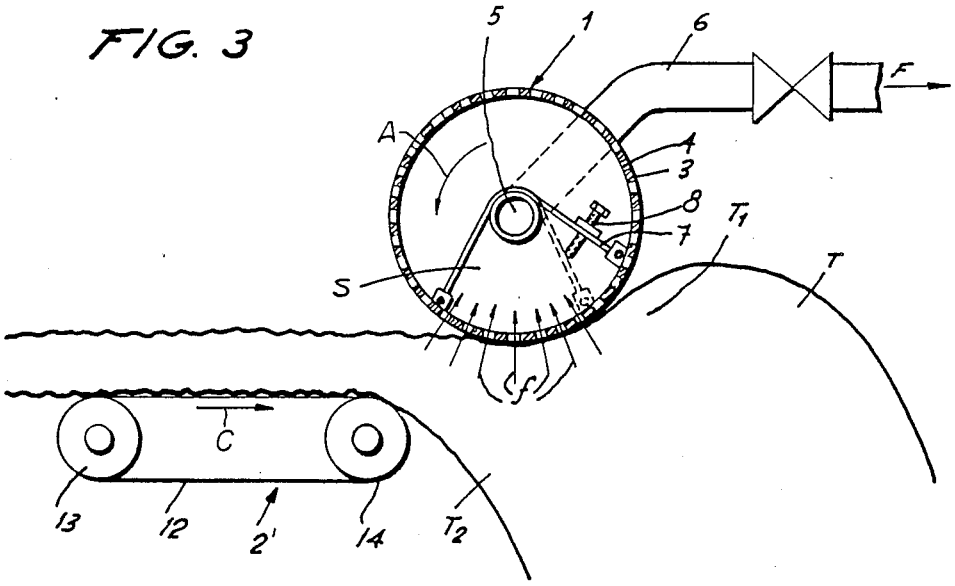
FIG. 3 is a view similar to FIG. 1 showing a third embodiment of the invention.

The secondary device instead of a rotary driving cylinder 9 can, as shown schematically in FIG. 3 at 2', constitute an apron 12 composed of two delivery and redelivery cylinders 13 and 14 of adjustable speed for controlling the linear speed of apron 12 in the direction of arrow C. Thus, this embodiment is a belt type conveyor.

Figure 4:
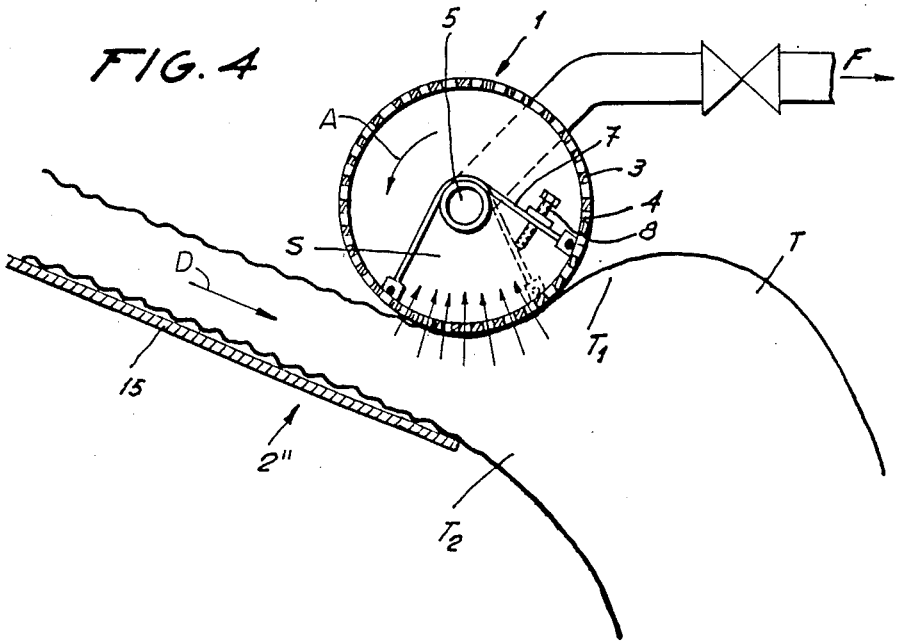
FIG. 4 is a view similar to FIG. 1 showing a fourth embodiment of the invention.

Also, the secondary device as shown at 2'' in FIG. 4 can consist of an inclined plane 15 for conveying fabric T in the direction of arrow D.

Such aprons 12 and inclined plane 15 can be in a fixed position or be tiltable.

This system for treating fabrics in accordance with this invention, can be applied to any process for treating fabrics in rope form in a closed ring.

Figure 5:
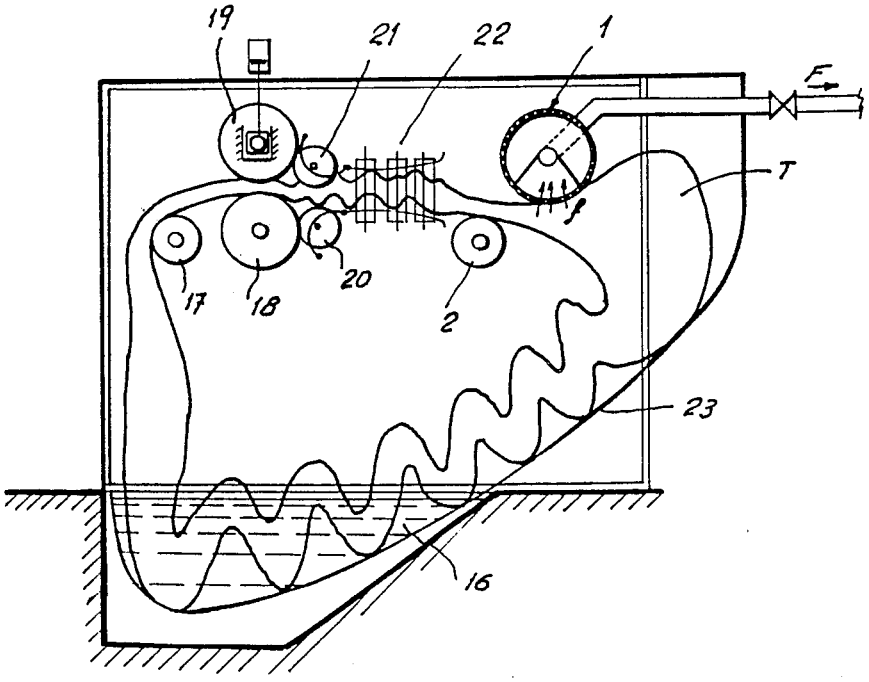
FIG. 5 is a schematic side elevational view showing the invention incorproated in a fulling-washing machine.

A specific application would be its arrangement in a fulling-washing machine as shown schematically in FIG. 5, although there are other applications. The application of this system in such a machine provides for the "opening" and sucking of the fabric in a closed ring inside the machine which enhances washing and fulling of the fabric because it is crossed by the liquid or treatment bath in each sucking of the main device 1.

In such fulling-washing machine the fabric in closed ring T rises from the lower bath 16 through an accompanying roller 17 to the actuator rollers 18, 19 of adjustable relative spacing after which it passes through the extractors 20, 21 and from them to the retaining box 22. At the outlet of the retaining box, the fabric T advances toward the system of the invention constituted by the main sucking device 1 and conveyor positioned above and the secondary device 2 positioned below, which main and secondary devices in addition to cooperating to produce the positive transport of the fabric in closed ring T, effect the opening of the fabric by displacing it transversally to its advancement direction, the fluids of the process being interchanged with the fabrics in the rope form and extracted in controllable degree from the fabrics. The fabric T then passes down the inclined plane 23 of the machine forming folds until reaching the bath 16, after which it rises again to the actuator rollers 18, 19. It is pointed out that in such a machine multiple ancillary elements have been omitted because not essential for systems utilizing the invention as described.

In this type of machine, obviously the main 1 and secondary 2 devices shown and described in FIGS. 1 to 4 will be applicable.

The secondary device with no sucking surface on cylinder 9 can be plain or provided with grooves to make the advancement of the fabric easier. In the case of the apron, or conveyor, it can include two delivery and redelivery rollers, as shown, or several rollers, some of which can be stretchers and guiding rollers, all effecting the approaching of the fabric in closed ring T to the conveying element of the main device.

In FIG. 2, in full line, are shown the rotary driving cylinder 9 of the secondary device lacking the sucking means and with the part T2 of the fabric not sucked and conveyed.

Also, in FIG. 2, in the dotted line, is shown rotary driving cylinder 9, provided with sucking F' by the duct 6' and the means to set the sucking 7' that provides the sucking f' and carriage of the fabric T, and therefore, the rest of the fabric T'2 is sucked and carried in a manner similar to part T1 by cylinder 3 of the main device 1.

It must be pointed out that preferably, the axle of the main device cylinder 3 will be above the axle of the fabric in closed ring T before its treatment, but it can also be below although not shown.

In an analogous way, it must be stated that the number of main and secondary devices can be any convenient number, e.g., to be arranged in pairs, or several of one type for each of another type, and thus there can exist several secondary devices for a single main device, or vice versa.

As can be observed, the action of opening the fabric, in rope form in a closed ring, unfolding it transversally to its advancement direction by the sucking effect of the main device, enhances and improves the condition and state of the fabric as finished and it improves and enhances the action of the process to which the involved fabric is subjected.

It must be understood that in the practical realization of the system of treatment of fabric in rope form in a closed ring, wet or dry, in accordance with this invention, any variation of details can be introduced without altering the essential characteristics thereof which are set forth in the following claims.

We claim:

1. Apparatus for treatment of fabrics in rope form circulated in a closed ring through the apparatus comprising:

a first device comprising, a driven, hollow, cylindrical roller rotatably mounted on a substantially horizontal axis, a perforated outer wall on said roller, suction means operatively connected with said roller for drawing air from outside said roller through the perforations therein into the hollow interior thereof, and restricting means in the hollow interior of said roller for restricting the area of said outer perforated wall connected to said suction means to a working suction area on a lower portion of said roller; and a positively driven second device mounted in a position relative to said first device for engagement with at least part of the outer surface of the fabric and for feeding the fabric to said working suction area of said first device so that a part of the fabric passing between said first and second devices engages in direct contact said working suction area of said roller and said suction draws said part of the fabric in direct contact with said working suction area transversely with respect to the direction of feed of the fabric, the remainder of the fabric falling by its own weight away from said first device thereby opening the fabric by increasing the cross-section of the fabric in at least said transverse direction.

2. The apparatus as claimed in claim 1 and further comprising:

adjusting means for adjusting said working suction area.

3. The apparatus as claimed in claim 1 wherein:

said restricting means comprises a substantially inverted V-shaped member having outer lower end portions in sliding contact with the interior surface of said outer wall of said roller for defining a substantially enclosed suction sector between said outer ends within said roller.

4. The apparatus as claimed in claim 3 and further comprising:

adjusting means for adjusting said working suction area.

5. The apparatus as claimed in claim 4 wherein:

said adjusting means comprises a movable side element on one side of said V-shaped member for varying the size of said suction sector; and set screw means mounted on said V-shaped member and operatively engaging said movable side element for adjusting the position of said movable side element relative to the other side of said V-shaped member.

6. The apparatus as claimed in claim 3 wherein:

said second device comprises a cylindrical roller.

7. The apparatus as claimed in claim 3 and further comprising:

means for adjusting the position of at least one of said devices with respect to the other device.

8. The apparatus as claimed in claim 7 and further comprising:

means for adjusting the position of at least one of said devices with respect to the other device.

9. The apparatus as claimed in claim 8 wherein:

said second device comprises a cylindrical roller.

10. The apparatus as claimed in claim 1 wherein:

said second device comprises a cylindrical roller.

11. The apparatus as claimed in claim 10 wherein:

said cylinder roller of said second device is mounted on an axis of rotation substantially parallel to and lying in a substantially horizontal plane below said cylindrical roller of said first device.

12. The apparatus as claimed in claim 11 wherein:

said cylindrical roller of said second device is upstream of said cylindrical roller of said first device with respect to the feed direction of the fabric.

13. The apparatus as claimed in claim 1 and further comprising:

means for adjusting the position of at least one of said devices with respect to the other device.

14. The apparatus as claimed in claim 1 wherein:

said second device comprises a belt conveyor means.

15. The apparatus as claimed in claim 1 wherein:

said suction means in combination with said perforated roller further provides for recirculation of processing fluids in the treatment of web fabrics.

* * * * *